US005503692A

United States Patent [19]

Martin et al.

[11] Patent Number: 5,503,692

[45] Date of Patent: Apr. 2, 1996

[54] ELIMINATION OF ALUMINUM-LITHIUM SHEET ANISOTROPY WITH SPF FORMING

[75] Inventors: Gardner R. Martin, Bend, Oreg.; Claire E. Anton, Vienna, Va.

[73] Assignee: Rockwell International Corp., Seal Beach, Calif.

[21] Appl. No.: 147,422

[22] Filed: Nov. 4, 1993

Related U.S. Application Data

[63] Continuation-in-part of Ser. No. 936,056, Aug. 26, 1992, abandoned, which is a continuation of Ser. No. 720,032, Jun. 24, 1991, abandoned.

[51] Int. Cl.[6] ..... C22F 1/04

[52] U.S. Cl. ..... 148/564; 148/690; 148/437; 148/438; 148/439; 148/440; 72/60; 72/364

[58] Field of Search ..... 148/564, 690, 148/437, 438, 439, 440; 72/60, 364

[56] References Cited

U.S. PATENT DOCUMENTS 4,516,419 5/1985 Agrawal ..... 72/60

4,874,440 10/1989 Sawtell et al. ..... 148/11.5 A 5,019,183 5/1991 Martin ..... 148/564

OTHER PUBLICATIONS

"Metals Handbook" (9th Edition); vol. 8, p. 553; ASM, Metals Park, Ohio, 1985.

*Primary Examiner*—David A. Simmons

*Assistant Examiner*—Robert R. Koehler

*Attorney, Agent, or Firm*—Terrell P. Lewis; Charles T. Silberberg

[57] ABSTRACT

A novel method is disclosed for removing or eliminating anisotropic material properties typically found in conventionally rolled or otherwise processed aluminum-lithium alloy products obtained from conventional aluminum fabrication mills. The method comprises imparting a predetermined amount of strain to the conventionally rolled alloy sheet whereby the alloy experiences dynamic recrystallization. Through this process, the mill-imposed crystallographic texturing, which initially sets up the undesired anisotropic characteristics, is eliminated. A preferred technique for imparting strain to the sheet stock is superplastic forming.

6 Claims, 1 Drawing Sheet

FIG. 1
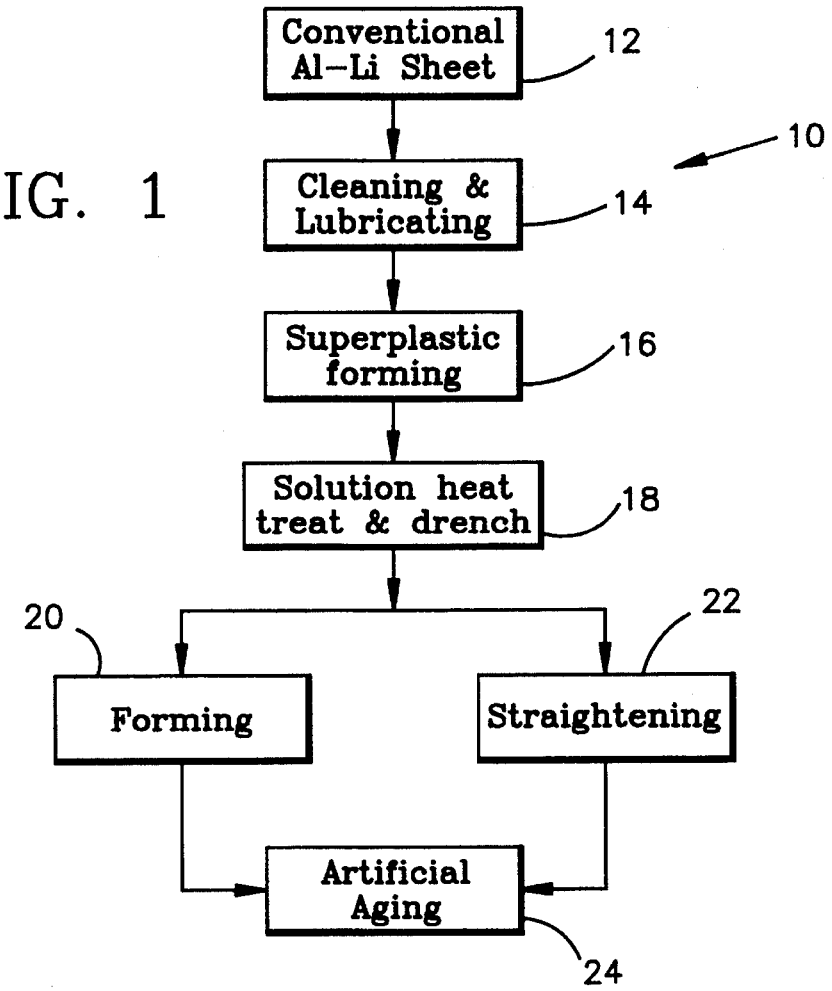
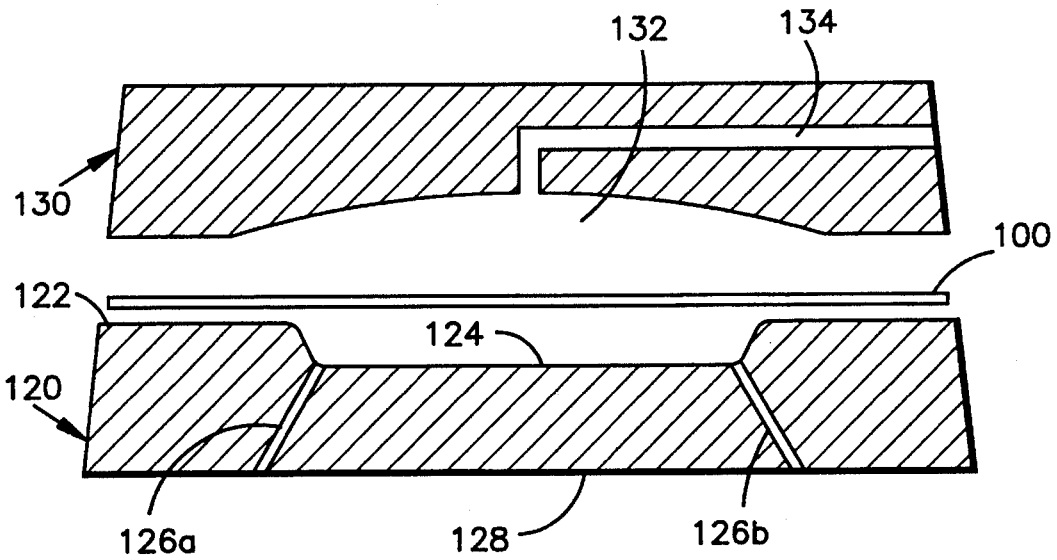
FIG. 2

ELIMINATION OF ALUMINUM-LITHIUM SHEET ANISOTROPY WITH SPF FORMING

This application is a continuation-in-part of application U.S. Ser No. 07/936,056 filed on Aug. 26, 1992, now abandoned, which in turn is a continuation of U.S. Ser. No. 07/720,032 filed Jun. 24, 1991, now abandoned.

BACKGROUND OF THE INVENTION

1. Field of the Invention

The present invention relates to the treatment of aluminum/lithium alloys which are suitable for aerospace air frame applications, and more particularly to an improved lithium-containing aluminum base alloy product obtained by eliminating anisotropic behavior (i.e., directional properties), and a method of producing the same.

2. Background of the Invention

In the aerospace industry, It has been generally recognized that one of the most effective ways to reduce the weight of a craft is to reduce the density of the materials used in its construction, while maintaining the maximum mechanical property characteristics.

The materials most typically contributing to the weight problem are metallic materials insofar as they fall to offer the strength-to-density and stiffness-to-density advantages that are obtainable in some of the advanced composite material systems.

For purposes of reducing aluminum alloy densities up to 20%, lithium additions have been made. It is known that such aluminum-lithium alloys can present high strength and stiffness, and exhibit good corrosion-resistance, and improved crack growth resistance, properties.

However, the addition of lithium to aluminum alloys is not without problems. For example, previous alloys of this kind have, in the past and in comparison to other aircraft alloys, suffered from a reduction In such properties as fracture toughness and decreased ductility, with associated problems in ingot casting and subsequent working. Where the use is for aircraft parts, it is imperative that the lithium-containing alloy have both improved fracture toughness and strength properties.

It is well known that mechanical deformation, by such conventional milling processes as hot and cold rolling, can lead to the development of a metallurgical condition known as "texturing", a phenomenom brought about by crystollographic preferred orientations In sheet or strip forms of metallic materials. These conditions are manifested as anisotropic material properties which can be detrimental to the mechanical properties and structural behavior of the product. For example, anisotropy of mechanical properties can result in an appreciable variation of the strength and ductility of the product depending on the direction within the plane of the sheet or strip in which the properties are measured.

OBJECTS AND SUMMARY THE INVENTION

It is therefore an object of the present invention to provide a novel method for removing or eliminating anisotropic material properties typically found in conventionally rolled or otherwise processed aluminum-lithium alloy products obtained from conventional aluminum fabrication mills.

Another object of the present invention is to provide a novel method for converting conventional mill-rolled aluminum lithium alloy sheet stock to a sheet product having little or no anisotropic properties, while retaining the desired properties of low density, high strength and high modulus.

These and other objects of the invention are achieved by imparting a predetermined, limited, amount of strain to conventional, relatively flat, mill-rolled sheet or plate stock using a superplastic forming (SPF) process before effecting final shaping of the sheet stock via conventional, non-SPF forming techniques, as for example stamping, press forming, brake forming, or machining. The strain-inducing, SPF preforming step causes dynamic recrystallization of the material without substantial deformation through which the mill-imposed crystallographic texturing, which initially sets up the unwanted anisotropic characteristics, is eliminated.

BRIEF DESCRIPTION OF THE DRAWINGS

FIG. 1 is a flow chart illustrating the various steps of the method of the present invention; and FIG. 2 depicts a cross-sectional view of the tool members used to achieve a strained condition in sheet stock using a superplastic gas forming technique.

DETAILED DESCRIPTION OF THE INVENTION

Broadly, to achieve the primary objective of the present invention, i.e., the elimination of anisotropic characteristics of structural and mechanical properties from conventional mill-rolled aluminum-lithium sheet stock purchased from a mill, the present Invention employs a preliminary step of superplastic forming to impart strain to the sheet stock.

Referring to FIG. 1, it is seen that the process 10 contemplated by the present invention embraces the use (block 12) of conventional "as-rolled" aluminum-lithium sheet stock purchased in mild temper from the mill, as for example, 2090-T3 aluminum lithium alloy material. The inventors have found that this "as-rolled" sheet stock typically exhibits anisotropic mechanical properties, with the greatest deviation generally taking place at or about a 45° orientation relative to the longitudinal axis of the sheet. Anisotropic properties of the "as rolled" aluminum lithium sheet are a direct result of the mill rolling process. During the rolling process, texturing of the microstructures results in the sheet causing maximum strength levels to occur in the rolling direction.

It is the goal of the present invention to attain a uniform distribution of the microstructures throughout the sheet thereby attaining a state of elimination of the anisotropic characteristics of the material. The inventors have discovered that this goal can be achieved by applying uniform strain to the sheet through the process of superplastic forming.

Superplastic forming is a technique in which unusually high tensile elongations are achieved concurrently with reduced tendency toward necking. Superplasticity is exhibited by aluminum and certain of its alloys, but only within a limited temperature and strain rate range.

In preparation for superplastic forming, the process involves the step (block 14) of cleaning and lubricating the material. Strain is then imparted to the material (block 16) using a superplastic forming technique In which the material and tools are heated to temperatures between 950° F. and 1015° F. The elimination of anisotropy in the material is achieved through high temperature deformations of no more than approximately 20%. In performing this step of the process, back pressure of approximately 400 psi maximum (a magnitude less than the forming pressure) is applied to the underside of the sheet stock to aid in preventing porosity from developing in the material, and for enhancement of consolidation of the material. Next, the superplastically formed sheet or part is trimmed and solution heat treated, and then followed by a quench (block 18). The sheet then may be either formed to a final configuration (block 20) or, as shown in block 22, straightened to eliminate distortion and then strained to final thickness (block 22). In both cases (i.e., the forming step of block 20 or the straightening step of block 22), the part is subjected to methods other than superplastic forming techniques, as for example press forming, stamping, brake forming, or machining, to achieve the final part configuration and dimensions. Finally, the solution heat-treated sheet can be artificially aged (block 24) at temperatures of from 350° F. to 375° F. for six (6) to forty-eight (48) hours to achieve optimum tensile (-T6 or -T8) properties. At this stage of the process, the anisotropic behavior is virtually eliminated.

FIG. 2 illustrates the details of the forming tools used in the method of the present invention to eliminate anisotropic properties In the "as formed" sheet of mill-purchased aluminum-lithium material. As shown in FIG. 2, the "as-rolled" sheet 100 is placed between a heatable lower forming tool 120 and a heatable upper forming tool 130. The upper forming tool includes a forming volume 132 which lies atop the portion of the sheet to be formed during this process, and a gas delivery channel 134 which communicates a source of pressurized gas with the forming volume. The lower forming tool 120 includes a first upper surface 122, a second depressed surface 124, and a pair of arrays of gas channels 126*a*, 126*b* extending about the perimeter of the second depressed surface 124 downwardly through and to a lower surface 128 of the forming tool. The gas channels are shown in one preferred orientation, i.e., at about a 45° angle to the plane of the lower surface 128. However, the invention contemplates channels which extend at any angle relative to the plane of the lower surface of the tool. The depressed surface 124 of the tool typically has a shallow, rectangular configuration.

Once the sheet is in place atop the lower pre-heated forming tool 120, and the two pre-heated tools have been aligned and sealed together in preparation for their use, the enclosed sheet is heated to the equilibrium temperature of the tools, i.e., approximately 950° to 980° F. Thereafter, gas forming pressure is Introduced to the space between the upper tool and the upper surface of the sheet through the gas delivery channel 134 In the upper tool. Gas back-pressure is simultaneously introduced through the array of channels 126*a*, 126*b* to provide a consolidation mechanism for the material whereby upper tool contact with the work piece is made unnecessary. Both the gas forming pressure and the back pressure are positive; however, the back-pressure of approximately 400 psi is less than the forming pressure. Through this process of forming at elevated temperatures, the sheet stock experiences superplastic deformation of approximately 20%. Moreover, through the use of this process, i.e., of subjecting the material to uniform, critical strain, the anisotropic characteristics of the material are effectively eliminated.

What we claim is:

1. A method for producing an aluminum-lithium shaped component, comprising:

providing a quantity of conventionally-treated aluminum-lithium alloy sheet stock, superplastically preforming said conventionally-treated alloy to effect a superplastic deformation of no more than substantially 20% and thereby dynamically alter the mill-imposed crystallographic texturing and effectively eliminate anisotropic characteristics in the alloy, solution heat treating said superplastically preformed alloy, quenching the solution heat treated preformed alloy, forming said heat treated alloy to attain a final shaped component using a non-superplastic forming technique, and artificially aging the solution heat treated and non-superplastically formed alloy to attain optimum tensile properties.

2. The method of claim 1, wherein said step of artificially aging said alloy takes place at temperatures of from 350° F. to 375° F. for from six (6) to forty-eight (48) hours.

3. The method of claim 1, wherein said step of superplastically preforming said conventionally-treated alloy is carried out at a temperature in the range of between 950° F. and 1050° F.

4. A method for producing an aluminum-lithium shaped component, comprising:

superplastically preforming a quantity of conventionally-treated mill-rolled sheet stock aluminum-lithium alloy to effect a superplastic deformation of no more than substantially 20%; and non-superplastically forming said preformed alloy to a final shape to obtain final dimensions and a final configuration, whereby during said preforming step, crystallographic texturing and resultant anisotropic characteristics in said mill-rolled sheet stock alloy are effectively eliminated.

5. The method of claim 4, wherein said non-superplastically forming step comprises press forming.

6. The method of claim 4, wherein said non-superplastically forming step comprises forming using a brake press.

* * * * *